US012089710B2

(12) United States Patent
Kim et al.

(10) Patent No.: US 12,089,710 B2
(45) Date of Patent: Sep. 17, 2024

(54) BAG PROVIDED WITH DESIGN PLATE

(71) Applicants: Hyeong Chan Kim, Suwon-si (KR); Min Jae Kim, Suwon-si (KR)

(72) Inventors: Hyeong Chan Kim, Suwon-si (KR); Min Jae Kim, Suwon-si (KR)

( * ) Notice: Subject to any disclaimer, the term of this patent is extended or adjusted under 35 U.S.C. 154(b) by 0 days.

(21) Appl. No.: 18/291,583

(22) PCT Filed: Aug. 12, 2022

(86) PCT No.: PCT/KR2022/012111

§ 371 (c)(1),
(2) Date: Jan. 24, 2024

(87) PCT Pub. No.: WO2023/018292

PCT Pub. Date: Feb. 16, 2023

(65) Prior Publication Data

US 2024/0260729 A1 Aug. 8, 2024

(30) Foreign Application Priority Data

Aug. 13, 2021 (KR) ..... 10-2021-0107108

(51) Int. Cl.
*A45C 13/08* (2006.01)
*A45C 13/10* (2006.01)

(52) U.S. Cl.
CPC ..... *A45C 13/08* (2013.01); *A45C 13/1023* (2013.01); *A45C 2013/1015* (2013.01)

(58) Field of Classification Search
CPC ..... A45C 13/08; A45C 13/1023; A45C 2013/1015

(Continued)

(56) References Cited

U.S. PATENT DOCUMENTS 3,575,226 A * 4/1971 Chapman ..... A45C 13/08 150/129
5,718,336 A * 2/1998 Haarlander ..... A45C 13/08 206/541

(Continued)

FOREIGN PATENT DOCUMENTS

DE 202007016008 U1 * 5/2009 ..... A45C 13/08
JP 3095737 U 8/2003

(Continued)

OTHER PUBLICATIONS

International Search Report for PCT/KR2022/012111 mailed Nov. 18, 2022 from Korean Intellectual Property Office.

*Primary Examiner* — Don M Anderson
*Assistant Examiner* — Justin Caudill
(74) *Attorney, Agent, or Firm* — Revolution IP, PLLC

(57) ABSTRACT

A bag provided with a design plate includes a bag body; a design plate which is formed in a plate material shape to partially cover an outer side of the bag body, and includes a first Velcro member on at least a part of an exposed surface exposed to the outside; a fixed module which includes a first fixed portion fixed to the bag body to be adjacent to one side of the design plate, and a second fixed portion fixed to the bag body to be adjacent to the other side of the design plate; and at least one design module fixed onto the exposed surface in an attachable and detachable manner, in which the first fixed portion and the second fixed portion include a second Velcro member and a third Velcro member that are attachable to the first Velcro member.

8 Claims, 6 Drawing Sheets

(58) Field of Classification Search
USPC ..... 206/457
See application file for complete search history.

(56) References Cited

U.S. PATENT DOCUMENTS

| | | | | |
|---|---|---|---|---|
| 10,813,436 | B2 * | 10/2020 | Hall | H04N 1/00344 |
| 2005/0067246 | A1 * | 3/2005 | Teicher | A45C 13/08 190/124 |
| 2010/0019011 | A1 * | 1/2010 | Sugano | B62B 5/0023 224/584 |
| 2012/0241059 | A1 * | 9/2012 | Wilson | A45C 13/08 150/105 |
| 2013/0032502 | A1 * | 2/2013 | Anderson | A45C 13/08 206/457 |
| 2016/0338472 | A1 | 11/2016 | Donahue | |
| 2017/0196344 | A1 | 7/2017 | Nakamura | |
| 2019/0008256 | A1 * | 1/2019 | Basham | A45C 15/00 |
| 2019/0289974 | A1 * | 9/2019 | Rifkind | A45C 13/08 |
| 2019/0298025 | A1 * | 10/2019 | Farghal | A45C 13/08 |
| 2020/0077771 | A1 * | 3/2020 | Jones | A45C 13/08 |
| 2020/0121049 | A1 * | 4/2020 | Wilcock | A45C 15/06 |

FOREIGN PATENT DOCUMENTS

| | | |
|---|---|---|
| KR | 20-1998-0015015 | 6/1998 |
| KR | 20-0431659 Y1 | 11/2006 |

* cited by examiner

【Figure 1】
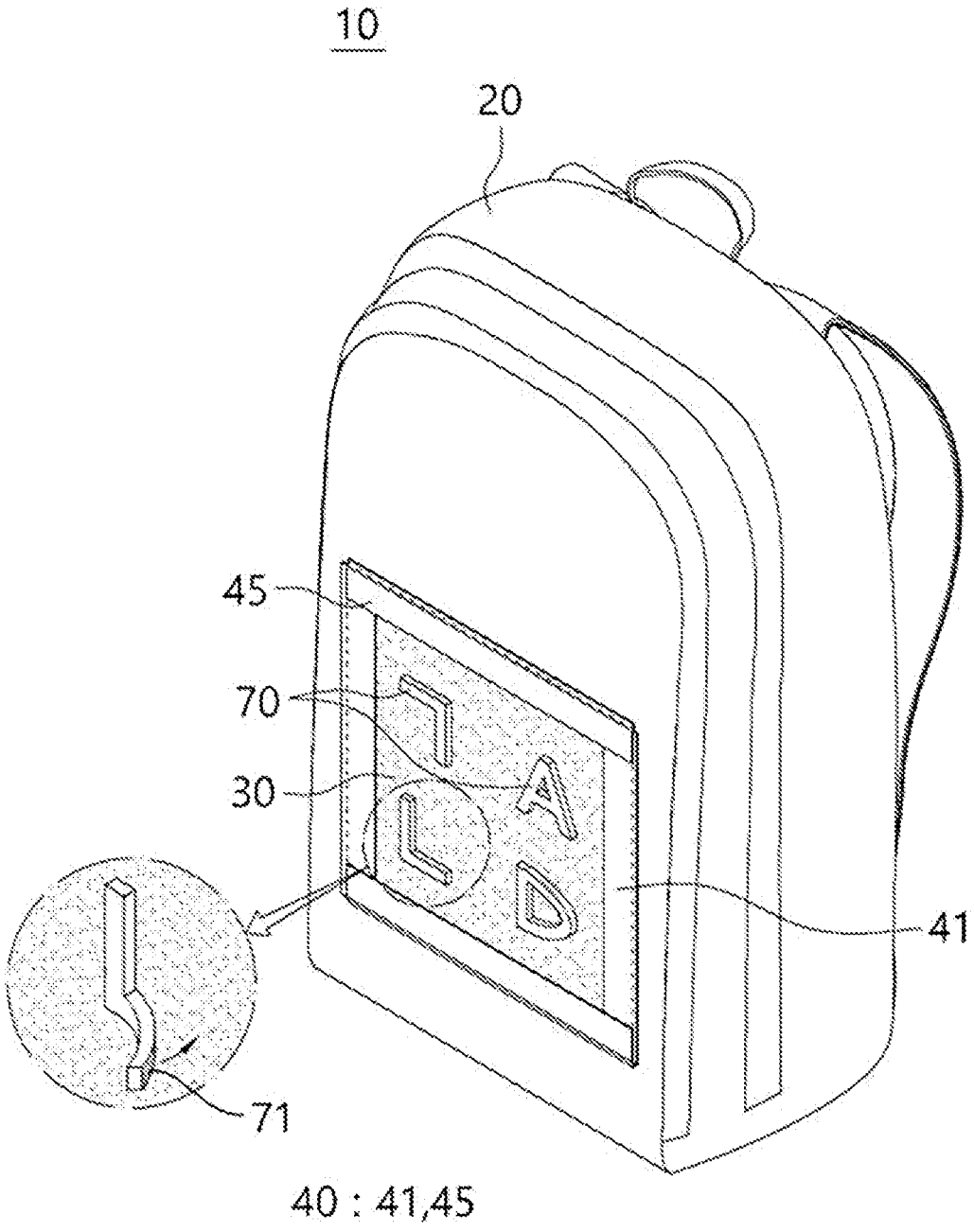

【Figure 2】
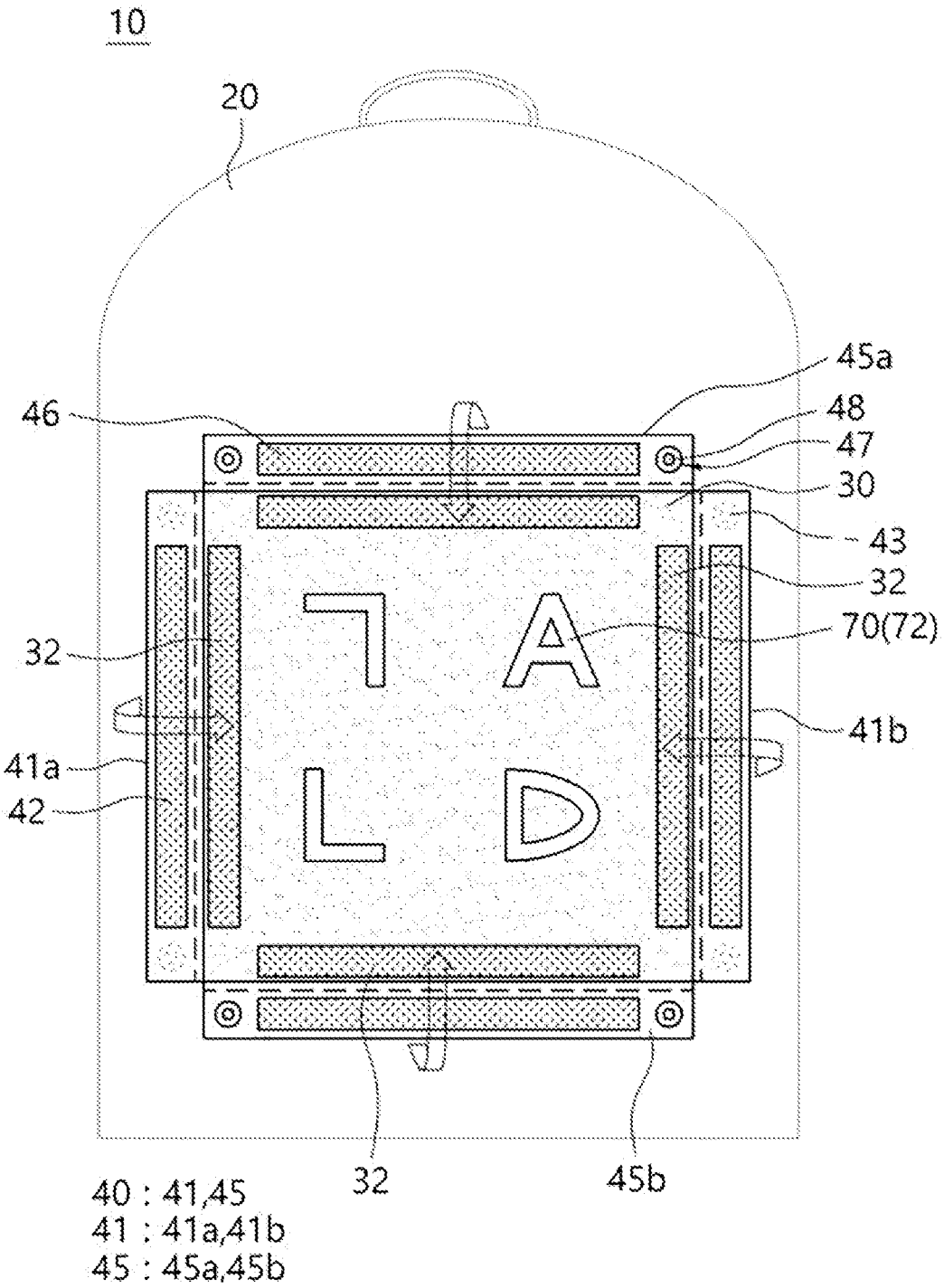

【Figure 3】
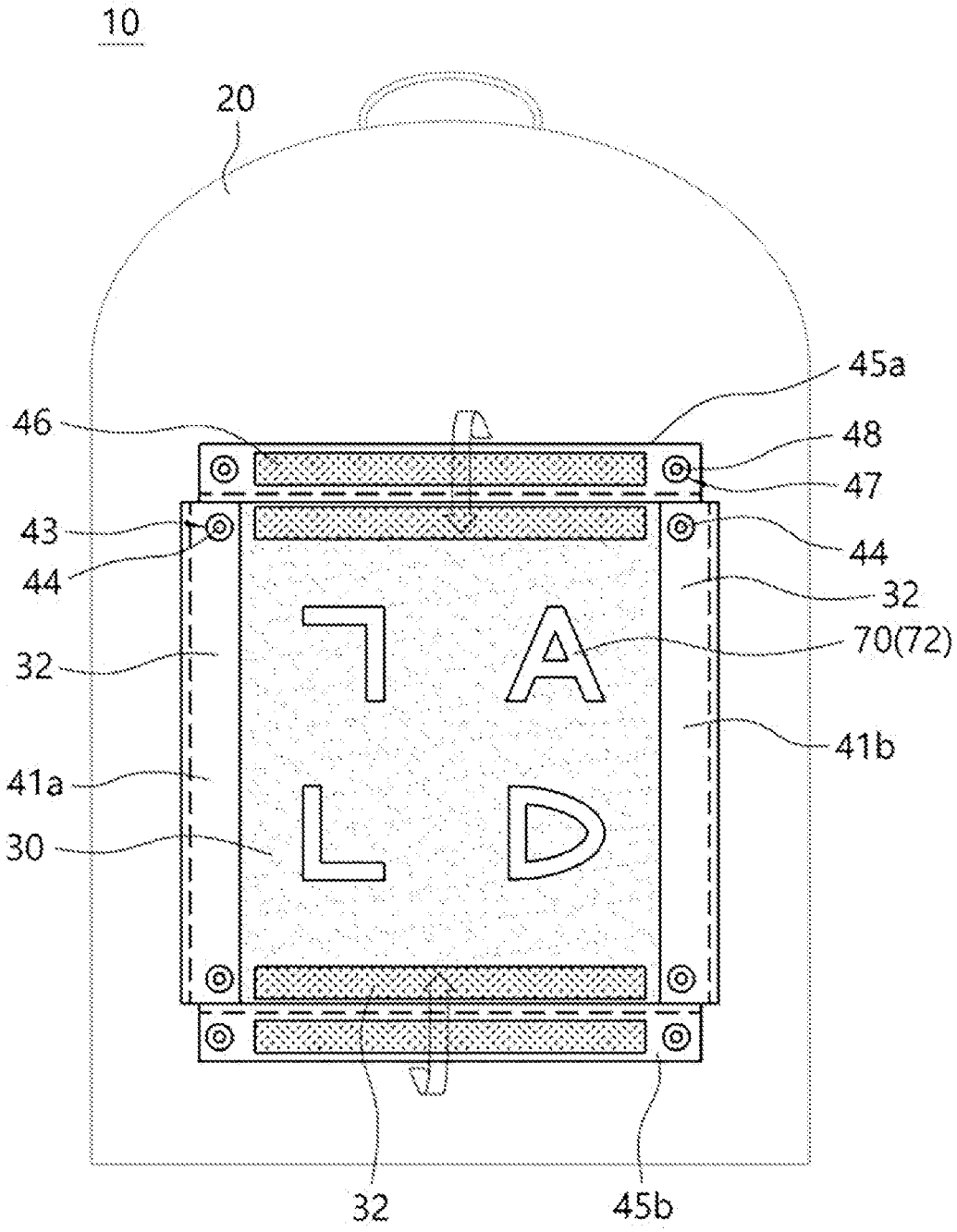

【Figure 4】
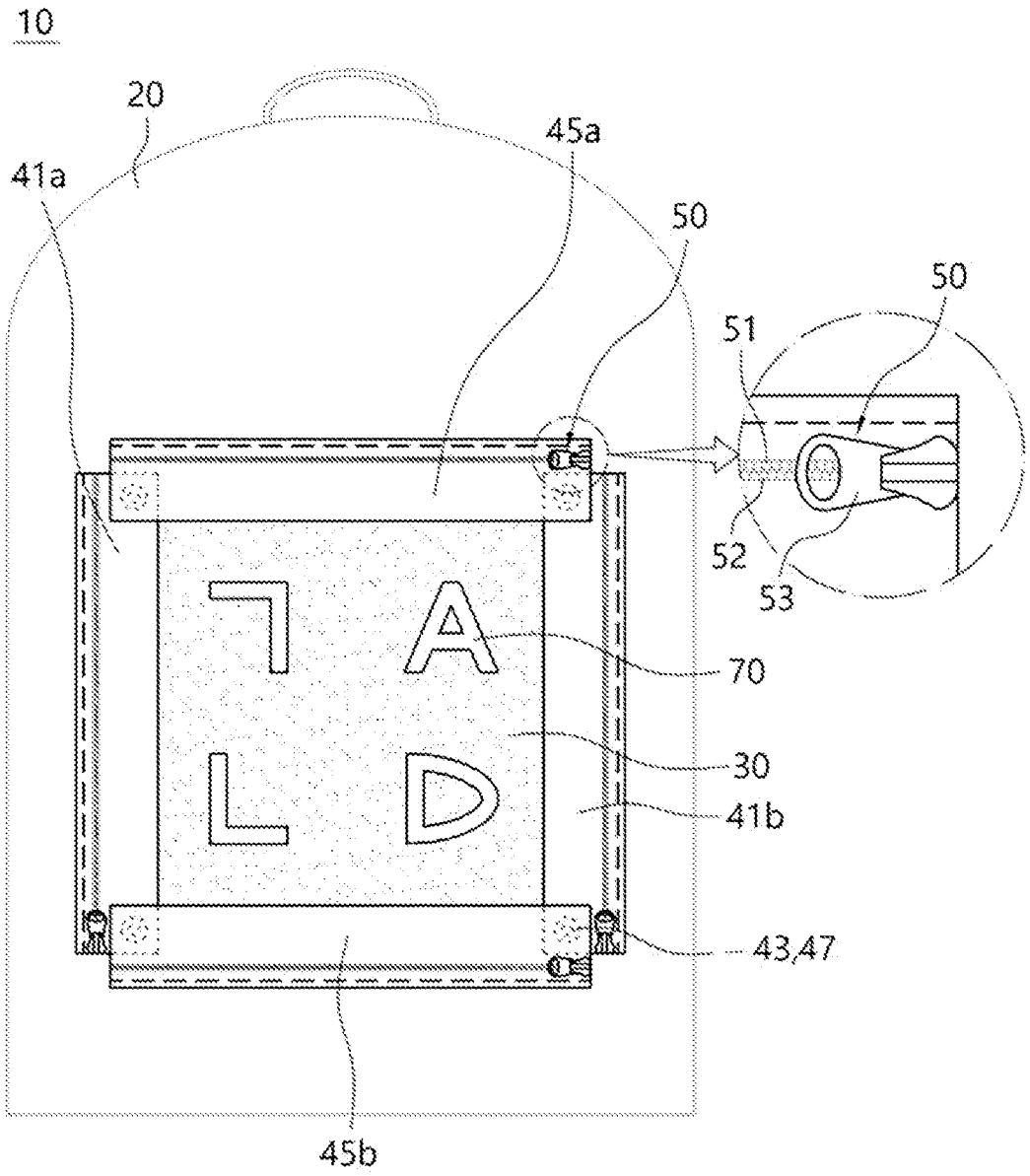

【Figure 5】
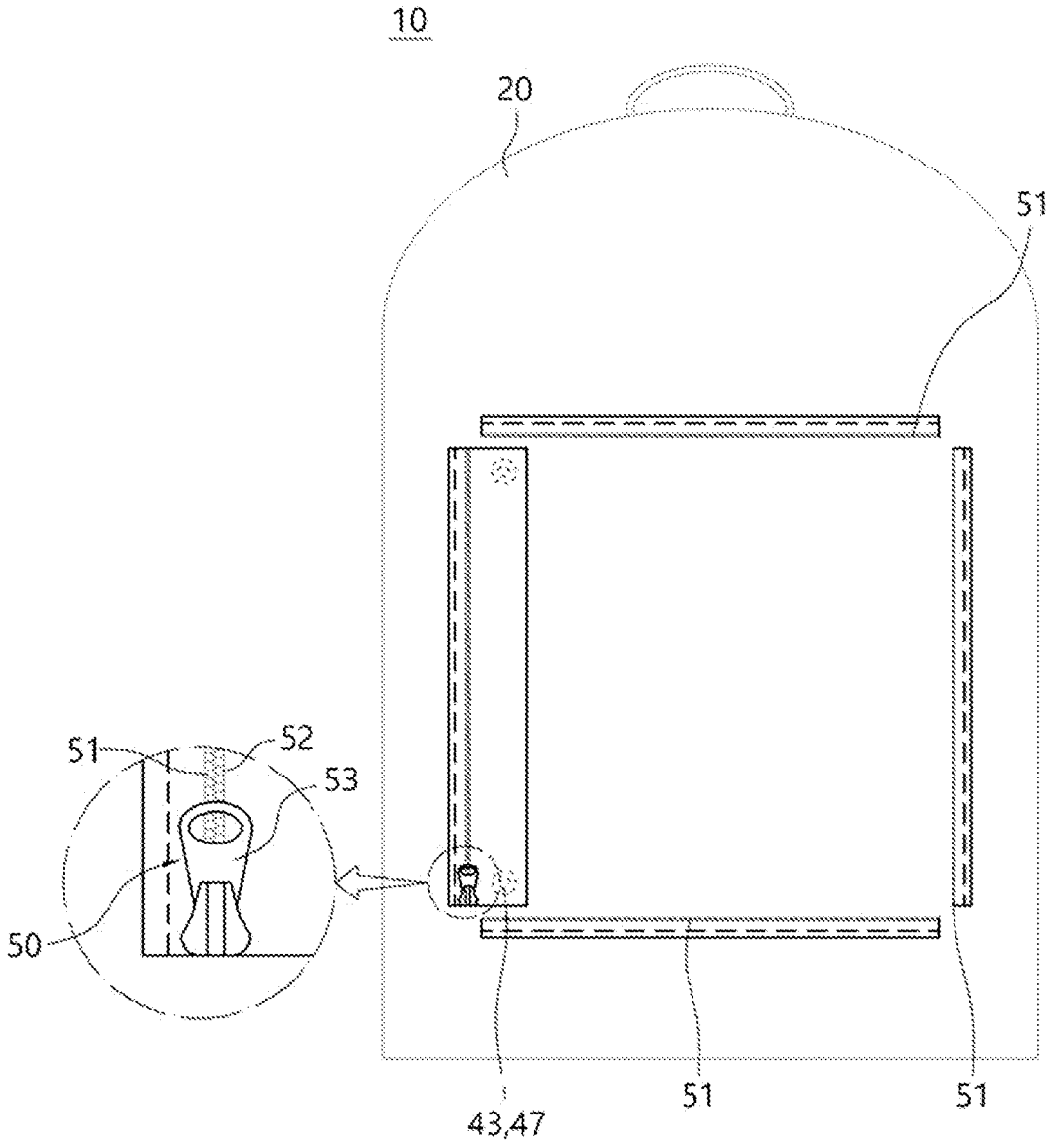

【Figure 6】
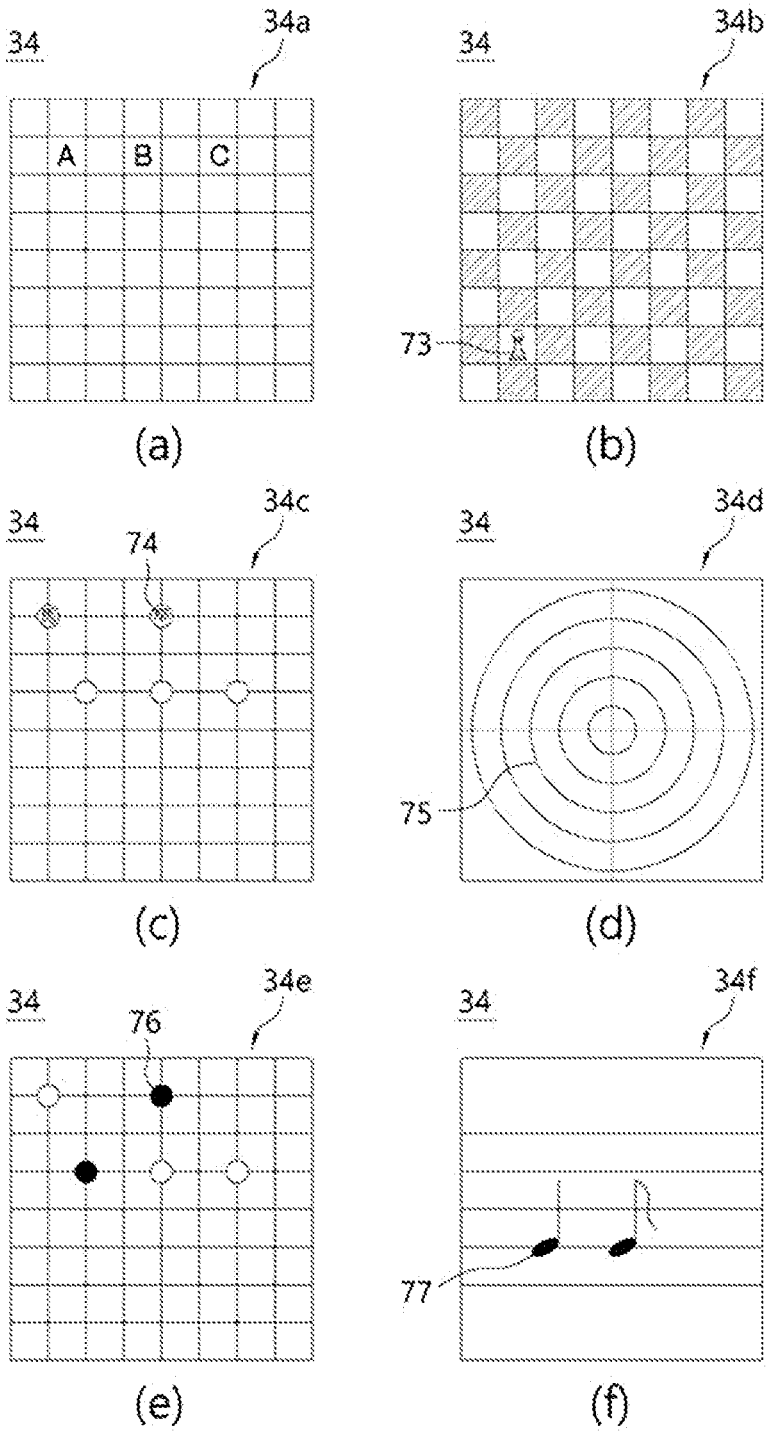

BAG PROVIDED WITH DESIGN PLATE

TECHNICAL FIELD

The present invention relates to a bag provided with a design plate, and more particularly to a bag provided with a design plate that can be detachably fixed to a bag body.

BACKGROUND ART

A bag is a tool that can be used to store and carry things, and is made of leather, cloth, vinyl, or the like. In other words, the bag is an item that is very close to people's lives, as seen from the fact that they are always carried around by people in their daily lives.

Considering the closeness to life and the constant portability of this bag, bags of various designs as much as clothing are produced and consumed to fully satisfy the decorative desires of various individuals.

However, bags are generally produced in large quantities in factories, and as a result, many bags with the same design are distributed on the market. Therefore, it is true that it is very difficult for individuals to obtain a unique bag that reflects their personal tastes. In other words, although it is possible to choose a bag that most closely matches one's tastes among bags of various designs, it is not easy to obtain a bag that perfectly reflects one's tastes.

When considering this reality, it is necessary to develop a bag whose design can be changed depending on tastes and preferences so that the bag wearer can fully express his or her individuality.

DISCLOSURE

Technical Problem

The present invention is devised in consideration of such circumstances, and an object thereof is to provide a bag whose design can be freely changed depending on individual preference.

In addition, another object of the present invention is to provide a bag whose design can be easily deformed and which can stably maintain the deformed design.

Technical Solution

To achieve the above objects, the present invention provides a bag provided with a design plate which includes a bag body; a design plate which is formed in a plate material shape to partially cover an outer side of the bag body, and includes a first hook and loop member on at least a part of an exposed surface exposed to the outside; a fixed module which includes a first fixed part fixed to the bag body to be adjacent to one side of the design plate, and a second fixed part fixed to the bag body to be adjacent to the other side of the design plate; and at least one design module fixed onto the exposed surface in an attachable and detachable manner, wherein the first fixed portion and the second fixed portion include a second hook and loop member and a third hook and loop member that are attachable to the first hook and loop member so as to fix the design plate to the bag body in an attachable and detachable manner.

At this time, when the design plate is fixed by the fixed module, a part of the first fixed portion and a part of the second fixed portion are disposed to overlap each other, the third hook and loop member is attached to the first hook and loop member with the second hook and loop member attached to the first hook and loop member, the first fixed portion may include first holders on both sides of an opposing surface opposite to a surface on which the second hook and loop member is disposed, and the second fixed portion may include second holders that engage with the first holders on both sides of a surface on which the third hook and loop member is disposed.

At this time, any one of the first holder and the second holder may be formed of a female fastening member having an engagement groove, and the other may be formed of a male fastening member which is inserted into the engagement groove and engaged.

At this time, the first fixed portions may be made up of a pair, and are disposed on each of both sides of the design plate, and the second fixed portions may be made up of a pair, and are disposed on each of upper and lower portions of the design plate.

At this time, the design plate may include the first hook and loop member on the entire exposed surface, and the design module may include a fourth hook and loop member attachable to the first hook and loop member.

At this time, the exposed surface of the design plate may be formed to have any one design of a manuscript paper, a chess board, a Korean chess board, a dart board, a target plate, a checkerboard and a music paper board.

At this time, the first fixed portion and the second fixed portion may be detachably engaged with the bag body by a zipper structure.

At this time, the design module may be formed to have any one shape of a letter, a number and a figure.

At this time, the exposed surface of the design plate may be formed to have a design that imitates a part of a masterpiece, and the design module may be formed to have a design that imitates another part of the masterpiece.

Advantageous Effects

The bag according to an embodiment of the present invention has various designs, and includes a design plate that is detachably fixed to the bag body, so that the bag can be decorated to reflect personal taste or additional functionality can be added to the bag.

Further, in the bag according to an embodiment of the present invention, the frame of the design plate can be entirely fixed through the first fixed portion and the second fixed portion.

Further, the bag according to an embodiment of the present invention continuously maintains a form in which the first fixed portion and the second fixed portion wrap around the design plate through physical engagement between a first holder and a second holder, thereby more firmly fixing the design plate to the bag body.

DESCRIPTION OF DRAWINGS

FIG. 1 is a perspective view showing a bag provided with a design plate according to an embodiment of the present invention, FIGS. 2 to 4 are diagrams sequentially showing a process of fixing the design plate to the bag body of FIG. 1, FIG. 5 is a diagram showing an example of a structure that fixes the fixed module to the bag body of FIG. 1, and FIG. 6 is a diagram showing various examples of exposed surface designs of the design plate of FIG. 1.

BEST MODE

Hereinafter, embodiments of the present invention will be described in detail with reference to the accompanying drawings so that those skilled in the art to which the present invention pertains can easily implement them. The invention may be embodied in several different forms and is not limited to the embodiments described herein. In order to clearly explain the present invention in the drawings, parts that are not related to the description are omitted, and the same or similar components are denoted by the same reference numerals throughout the specification. Furthermore, the sizes and shapes of components shown in the drawings may be exaggerated for clarity of explanation and convenience.

FIG. 1 is a perspective view of a bag provided with a design plate according to an embodiment of the present invention. FIGS. 2 to 4 are diagrams sequentially showing a process of fixing the design plate to the bag body of FIG. 1, and FIG. 5 is a diagram showing an example of a structure that fixes the fixed module to the bag body of FIG. 1. Further, FIG. 6 is a diagram showing various examples of exposed surface designs of the design plate of FIG. 1.

A bag 10 provided with a design plate according to an embodiment of the present invention (hereinafter referred to as a "bag") is a bag in which a design plate 30 of various forms is fixed to a bag body 20 having a fixed shape, and an appearance can be partially changed as needed.

At this time, the bag 10 according to an embodiment of the present invention includes a unique fixed module 40, so that the design plate 30 can be stably and easily fixed to the bag body 20.

To this end, the bag 10 according to an embodiment of the present invention may include a bag body 20, a design plate 30, a fixed module 40 and a design module 70.

First, the bag body 20 may be any of various known bags whose appearance is changed by the design plate 30, and which are formed to accommodate articles therein.

Although the bag body 20 is shown as a backpack in the drawings, the embodiments of the present invention are not limited thereto, and in addition to the above-mentioned backpack, it can be any type of bag such as cross bags, shoulder bags, handbags, clutch bags, document bag, women's bag or men's bag.

Next, the bag 10 according to an embodiment of the present invention may include a design plate 30 detachably fixed to the bag body 20.

At this time, the design plate 30 can be formed in a plate material shape to cover a part of the outside of the bag body 20, as shown in FIGS. 1 and 2. The bag body 20 formed in a plate material shape in this manner can have an exposed surface exposed to the outside, and an opposing surface (not shown) that is opposite to the exposed surface and abuts against the bag body 20.

At this time, the exposed surface may include a first hook and loop member 32 that is in contact with and coupled to second to fourth hook and loop members 42, 46, and 71, which will be described later. Here, the first hook and loop member 32 may be formed entirely on the exposed surface, or may be formed partially on only a part of the exposed surface.

The design plate 30 can be detachably engaged with the bag body 20 by the fixed module 40 through the first hook and loop member 32, and the design module 70, which will be described later, can be fixed effectively onto the exposed surface. This will be discussed later.

On the other hand, in this specification, the first hook and loop member to the fourth hook and loop member can be formed of a known Velcro™ in which a hook and an engagement ring form a pair. Further, the first to fourth hook and loop members may be formed of known attachment members that come into contact with each other to generate adhesive force. As a specific example, the first hook and loop member to the fourth hook and loop member may be formed to include "Dual Lock" manufactured by 3M Company.

In one embodiment of the present invention, the exposed surface can be formed to have a variety of designs 34.

As a specific example, the exposed surface of the design plate 30 may have a design such as a manuscript paper 34*a*, a chess board 34*b*, a Korean chess board 34*c*, a target board 34*d*, a checkerboard 34*e*, or a musical score board 34*f*, as shown in FIG. 6. In addition, the design plate 30 can have designs in various forms, such as a dart plate, a board game plate, or a Yut game plate (a traditional Korean board game).

Further, the design plate 30 may have a design including part or all of a masterpiece. For example, the design plate 30 may be formed of a design that imitates part or all of the background of the widely known masterpiece, Mona Lisa (by Leonardo da Vinci). At this time, the user may attach a design module 70 formed to imitate the entire woman or a part of the woman's body (for example, eyebrows, hair, etc.) included in the Mona Lisa painting to the design plate 30, thereby forming three-dimensional designs that imitate a masterpiece. Meanwhile, the design plate 30 may be formed in a form that imitates all or part of the abstraction completed by an artist such as Mondrian. In this case, similarly, the user can attach the design module 70 having a shape corresponding to a part of the abstraction to the design plate 30 to complete a three-dimensional imitated design.

In this way, the bag 10 according to an embodiment of the present invention can satisfy various purposes of users such as design purposes through a change in the outer shape of the bag, entertainment purposes through games, or art education purposes through the masterpiece design, through the design plate 30 having various designs.

Since the bag 10 according to an embodiment of the present invention has various designs as described above, and has the design plate 30 that is detachable from the bag body 20, the appearance of the bag body can be changed to an original design.

Further, since the bag 10 according to an embodiment of the present invention can use the design plate 30 as a tool for playing a specific game such as a chess board 34*b*, a Korean chess board 34*c*, and a target board 34*d*, various functions can be provided to the user in addition to the appearance modification function described above.

In particular, since the bag 10 according to an embodiment of the present invention fixes members that are cumbersome or difficult to store, such as the chess board 34*b* and the checkerboard 34*e*, on the outside of the bag body 20 in the form of a design plate 30, instead of storing the members in the bag body 20, more space-efficient storage is enabled.

The bag 10 according to an embodiment of the present invention may include a unique fixed module 40 for fixing the above-described design plate 30 to the bag body 20.

At this time, the fixed module 40 may include a first fixed portion 41 disposed adjacent to one side of the design plate 30, and a second fixed portion 45 disposed adjacent to the other side of the design plate 30.

As an illustrative example, as shown in FIGS. 2 to 4, the first fixed portion 41 may include a pair 41*a* and 41*b* disposed at both sides of the design plate 30, respectively. Similarly, the second fixed portion 45 may include a pair of 45*a* and 45*b* disposed at the upper and lower portions of the design plate 30, respectively.

At this time, as shown in FIG. 2, one surface of the first fixed portion 41 may be provided with a second hook and loop member 42 that can be attached to the first hook and loop member 32 described above. Furthermore, a third hook and loop member 46 that can be attached to the first hook and loop member 32 may also be provided on one surface of the second fixed portion 45.

By attaching the second hook and loop member 42 and the third hook and loop member 46 to the first hook and loop member 32 of the design plate 30, the design plate 30 can be easily attached to the bag body 20. Hereinafter, the aforementioned fixing of the design plate 30 by attachment between the first hook and loop member 32 and the second and third hook and loop members 42 and 46 will be defined as "primary fixing".

On the other hand, referring to FIG. 3, first holders 43 may be provided on both sides of the opposing surface of the first fixed portion 41 opposite to the surface on which the second hook and loop member 42 is disposed. Second holders 47 that engage with the first holders 43 may be provided on both sides of the surface of the second fixed portion 45 on which the third hook and loop member is disposed.

At this time, the first holder 43 and the second holder 47 may be formed of a known snap button, one of which may be formed of a female fastening member having an engagement groove 44, and the other of which may be formed of a male fastening member having a protrusion 48 that is inserted into and engaged with the engagement groove 44. However, it is only an example that the first holder 43 and the second holder 47 are formed of snap buttons, and the first holder 43 and the second holder 47 may be formed by adopting a known engagement member structure that includes a female fastening member and a male fastening member.

The first holder 43 and the second holder 47 are a "secondary fixing" structure for supplementing the fixing force of the above-mentioned primary fixing, and can more stably fixing the design plate 30 to the bag body 20, by restraining the first fixed portion 41 and the second fixed portion 45 surrounding the design plate 30 from being detached from the design plate 30.

Hereinafter, the process of fixing the design plate 30 by the fixed module 40 will be discussed in more detail with reference to FIGS. 2 to 4.

As shown in FIG. 2, in a state in which the first fixed portion 41 and the second fixed portion 45 expose the hook and loop members 42 and 46 to the outside, the design plate 30 can be placed in a space formed between the first fixed portion 41 and the second fixed portion 45 (hereinafter referred to as the "first state").

In the first state, the first fixed portion 41 may be rotated such that the second hook and loop member 42 of the first fixed portion 41 is attached to the first hook and loop member 32 of the design plate 30 as in FIG. 3 (hereinafter referred to as "second state"). In this case, the first holder 43 of the first fixed portion 41 can be exposed to the outside.

Next, in the second state, as shown in FIG. 4, the second fixed portion 45 may be rotated such that the third hook and loop member 46 of the second fixed portion 45 is attached to the first hook and loop member 32 (hereinafter referred to as "third state"). At this time, the second holder 47 disposed on the same surface as the third hook and loop member 46 may be engaged with the first holder 43 exposed to the outside. That is, for engagement between the first holder 43 and the second holder, a part of the first fixed portion 41 and a part of the second fixed portion may be disposed to overlap.

In this way, the bag 10 according to an embodiment of the present invention fixes the frame of the design plate 30 as a whole through the second hook and loop member and the third hook and loop member 46 (primarily fixing), and maintains a state in which the first fixed portion 41 and the second fixed portion 45 wrap around the design plate 30 through a physical engagement between the first holder 43 and the second holder 47, thereby rigidly fixing the design plate 30 to the bag body 20.

On the other hand, in an embodiment of the present invention, the first fixed portion 41 and the second fixed portion 45 may be engaged with the bag body 20 so as to be detachable from the bag body 20.

As a specific example, referring to FIGS. 4 and 5, the bag body 20 may be provided with a first portion 51 that serves as a part of a zipper structure 50. In this case, as a slider 53 moves with the second portions 52 of the fixed portions 41 and 45 disposed adjacent to the first portion 51, the first portion 51 and the second portion 52 described above may attain a rigid zipper engagement.

In this way, in the bag 10 according to an embodiment of the present invention, when it is not necessary to fix the design plate 30 to the bag body 20 as necessary, the first fixed portion 41 and the second fixed portion 45 may be completely detached from the bag body 20, thereby providing a simpler form of bag appearance.

Referring again to FIG. 1, the bag 10 according to an embodiment of the present invention may include a design module 70 detachably fixed to the exposed surface of the design plate 30.

In this case, the design module 70 is fixed on the design plate 30 by having the form of letters, patterns, numbers, designs 72, and the like, as shown in FIG. 1, and can perform decorative functions to make the appearance of the bag 10 more beautiful.

As an example, a student who wears the bag 10 may attach a plurality of design modules 70 having shapes such as letters and numbers to the design plate 30, and then combine them to form a desired word or message, thereby decorating his/her own bag up to individual preference.

Further, as shown in FIG. 6, when the design plate 30 has designs 34 such as a chess board **34*b*, a Korean chess board 34*c*, a checkerboard 34*e*, a music paper board 34*f*, and the like, the design module 70 may be formed of a chess piece 73, a Korean chess piece 74, an arrow 75, a go stone 76, a musical note 77, or the like, thereby performing a specific function harmoniously with the design plate 30**.

In an embodiment of the present invention, in a state in which the design module 70 of various forms is provided in the storage space inside the bag 10, when necessary, the user can extract the design module 70 from the bag 10, and then attach it to the design plate 30, thereby changing the external shape of the bag, or enjoying games such as chess, Korean chess, or go.

In this case, the design module 70 may include various known engagement members to be fixed onto the design plate 30, and as an example, as shown in FIG. 1, it may also include a fourth hook and loop member 71 that can be attached to the first hook and loop member 32 on one surface of the design plate 30.

In this way, the bag 10 according to an embodiment of the present invention is able to fix various types of design modules 70 to the design plate 30, and the bag 10 may be decorated to reflect personal tastes or various functions of the design plate 30 can be assisted.

While preferred embodiments of the present invention have been shown and described above, the present invention is not to be limited to the particular embodiments described above, and it will be understood by those skilled in the art who understand the idea of the present invention that other embodiments may be presented by adding, changing, deleting, or adding components within the scope of the same technical idea as the present invention.

The invention claimed is:

1. A bag provided with a design plate, comprising:

a bag body;

a design plate which is formed in a plate material shape to partially cover an outer side of the bag body, and includes a first hook and loop member on at least a part of an exposed surface exposed to the outside;

a fixed module which includes a first fixed portion fixed to the bag body to be adjacent to one side of the design plate, and a second fixed portion fixed to the bag body to be adjacent to the other side of the design plate; and at least one design module fixed onto the exposed surface in an attachable and detachable manner, wherein the first fixed portion and the second fixed portion include a second hook and loop member and a third hook and loop member that are attachable to the first hook and loop member so as to fix the design plate to the bag body in an attachable and detachable manner, wherein when the design plate is fixed by the fixed module, a part of the first fixed portion and a part of the second fixed portion are disposed to overlap each other, the third hook and loop member is attached to the first hook and loop member with the second hook and loop member attached to the first hook and loop member, the first fixed portion includes first holders on both sides of an opposing surface opposite to a surface on which the second hook and loop member is disposed, and the second fixed portion includes second holders that engage with the first holders on both sides of a surface on which the third hook and loop member is disposed.

2. The bag provided with a design plate according to claim 1, wherein any one of the first holder and the second holder is formed of a female fastening member having an engagement groove, and the other is formed of a male fastening member which is inserted into the engagement groove and engaged.

3. The bag provided with a design plate according to claim 1, wherein the first fixed portions are made up of a pair, and are disposed on each of both sides of the design plate, and the second fixed portions are made up of a pair, and are disposed on each of upper and lower portions of the design plate.

4. The bag provided with a design plate according to claim 1, wherein the design plate includes the first hook and loop member on the entire exposed surface, and the design module includes a fourth hook and loop member attachable to the first hook and loop member.

5. The bag provided with a design plate according to claim 1, wherein the exposed surface of the design plate is formed to have any one design of a manuscript paper, a chess board, a Korean chess board, a dart board, a target plate, a checkerboard, and a music paper board.

6. The bag provided with a design plate according to claim 1, wherein the first fixed portion and the second fixed portion are detachably engaged with the bag body by a zipper structure.

7. The bag provided with a design plate according to claim 1, wherein the design module is formed to have any one shape of a letter, a number, and a figure.

8. The bag provided with a design plate according to claim 1, wherein the exposed surface of the design plate is formed to have a design that imitates a part of a masterpiece, and the design module is formed to have a design that imitates another part of the masterpiece.

* * * * *